United States Patent [19]

Horn

[11] 4,093,267

[45] June 6, 1978

[54] SKI BRAKE

[75] Inventor: Hans Horn, Wellington, New Zealand

[73] Assignee: TMC Corporation, Baar, Zug, Switzerland

[21] Appl. No.: 708,597

[22] Filed: Jul. 26, 1976

[30] Foreign Application Priority Data

Jul. 24, 1975 Austria ..... 5749/75

[51] Int. Cl.[2] ..... A63C 7/10

[52] U.S. Cl. ..... 280/605

[58] Field of Search ..... 280/605, 604, 601

[56] References Cited

U.S. PATENT DOCUMENTS

| | | | |
|---|---|---|---|
| 3,877,709 | 4/1975 | Fritz | 280/605 |
| 3,899,185 | 8/1975 | Martin | 280/605 |
| 3,930,659 | 1/1976 | Salomon | 280/605 |
| 4,033,603 | 7/1977 | Horn | 280/618 |

FOREIGN PATENT DOCUMENTS

| | | | |
|---|---|---|---|
| 2,533,465 | 2/1976 | Germany | 280/605 |
| 368,078 | 8/1939 | Italy | 280/605 |
| 349,911 | 12/1960 | Switzerland | 280/605 |

*Primary Examiner*—Joseph F. Peters, Jr.
*Assistant Examiner*—Milton L. Smith
*Attorney, Agent, or Firm*—Blanchard, Flynn, Thiel, Boutell & Tanis

[57] ABSTRACT

An automatically actuated ski brake is associated with a heel holding device and is activated upon opening of the heel holding device. The brake includes a pair of pivoted spur members resiliently urged into braking position. A catch or lock device is arranged for holding the pivoted members above the ski and a spring device urges the lock device into a position holding the brake members above the ski. The heel holding device is provided with a cam for moving the lock device away from locking engagement with the brake members when the binding moves to an open position. The lock device includes a camming member permitting the cam to ride upon the lock member without releasing the lock member when the heel holding member is moved to a closed position.

5 Claims, 10 Drawing Figures

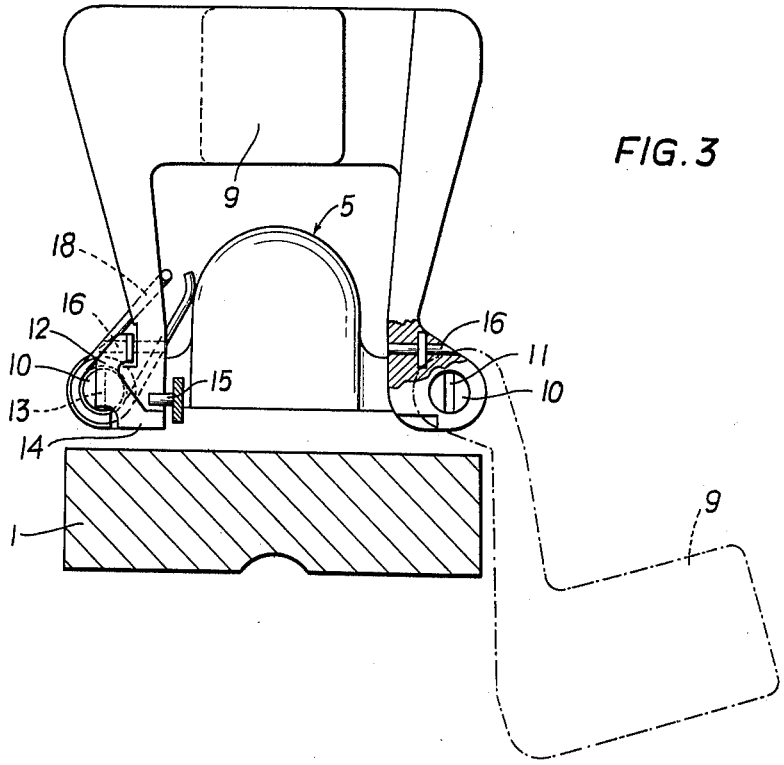
FIG. 3
FIG. 6
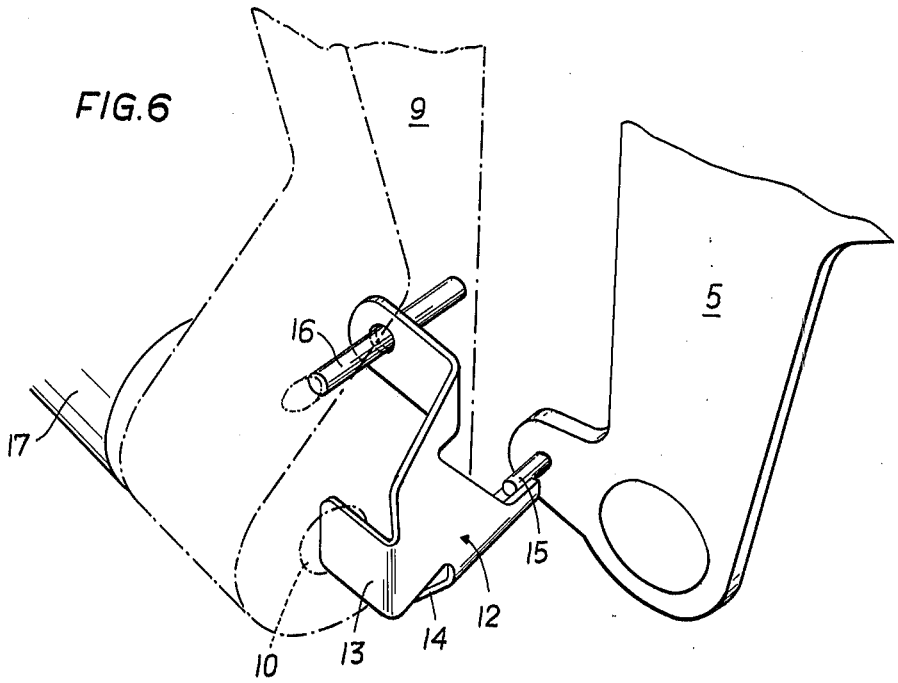

SKI BRAKE

FIELD OF THE INVENTION

The invention concerns a ski brake having brake wings arranged on both sides of the ski and positionable above the top ski surface in the running position, which after the ski boot is detached from the ski will respond to the operation of a spring preferably arranged between a supporting housing and the brake wings, for pivoting said wings into the braking position, and which ski brake operates in cooperation with a safety ski binding.

BACKGROUND OF THE INVENTION

A ski brake which cooperates with the holding mechanism of a safety ski binding is, for example, described in Geze Pat. Nos. 308,610 and 310,631 Geze (XXIII) and in German Offenlegungsschrift No. 3,360,338 Altenburger (XXIII). All of the mentioned constructions have in common that the ski brake is held by the heel holder and releases the ski brake upon release of the said heel holder.

A known drawback of both constructions first abovementioned, is that in order to hold down the ski brake when one gets out of the ski binding, a separate stop lever is necessary so that the sole plate on which the heel holder is arranged is held locked. The stop lever is brought into operation only by a fall, and then the hold down means together with the sole plate is held against a resilient stop device. However, this means that in a fall the added resistance must be considered. Consequently, the release spring must be separately adjusted for each set of requirements. Further, in the construction mentioned lastly, the complete assembly is complicated because the operational arrangement extends under and along the ski binding.

The type of ski brake mentioned above will be applied in particular to a safety ski binding that will hold the ski boot to the ski through the intermediary of a sole plate. It is not readily possible in a safety ski binding which has a sole plate to cause the ski brake to be operated by the heel holder, since in the case of the plate binding, the heel holder and a front jaw serve to firmly hold the boot on the plate, and the plate is held on the ski by separate means which operate the safety release. Upon an intentional or accidental release the plate is removed with the boot from the ski, so that the heel holder is not even operated during the release. Therefore, the problem exists to design a ski brake of the above-mentioned type so that it can also be used effectively in plate bindings.

This purpose is inventively attained through an engaging and releasing catch which is provided in order to hold the wings of the ski brake in the running position. Same is brought by a spring to a holding position and is by action of a cam arranged on the ski binding (preferably on the heel holder) securely held in the holding position. Upon release of the ski binding in relation to the heel holder, said catch is caused to pivot against the force of the spring and is released.

The ski brake, provided according to the invention, cooperates with the heel holder and is automatically activated after the release of the boot. This will always be the case with the so-called plate binding, if the plate after the release procedure remains on the ski. But also for the safety release binding in which the heel holder and the front jaw separate from each other, this procedure occurs when the safety release ensues through the front jaw, presuming that at the same time the heel holder opens, as is the case, for example, with the thrust controlled heel holder.

BRIEF DESCRIPTION OF THE DRAWINGS

Further advantages and details of the invention will be described in more detail in connection with the drawings, which illustrate one exemplary embodiment. In the drawings:

FIGS. 1 and 2 are associated views of a plate binding having the inventive ski brake, wherein FIG. 1 is a side view and FIG. 2 is a top view of FIG. 1;

FIG. 3 is a cross-sectional view along the line III–III of FIG. 2;

FIG. 6 is a diagrammatic illustration still more enlarged; and

DETAILED DESCRIPTION

Figure 1:
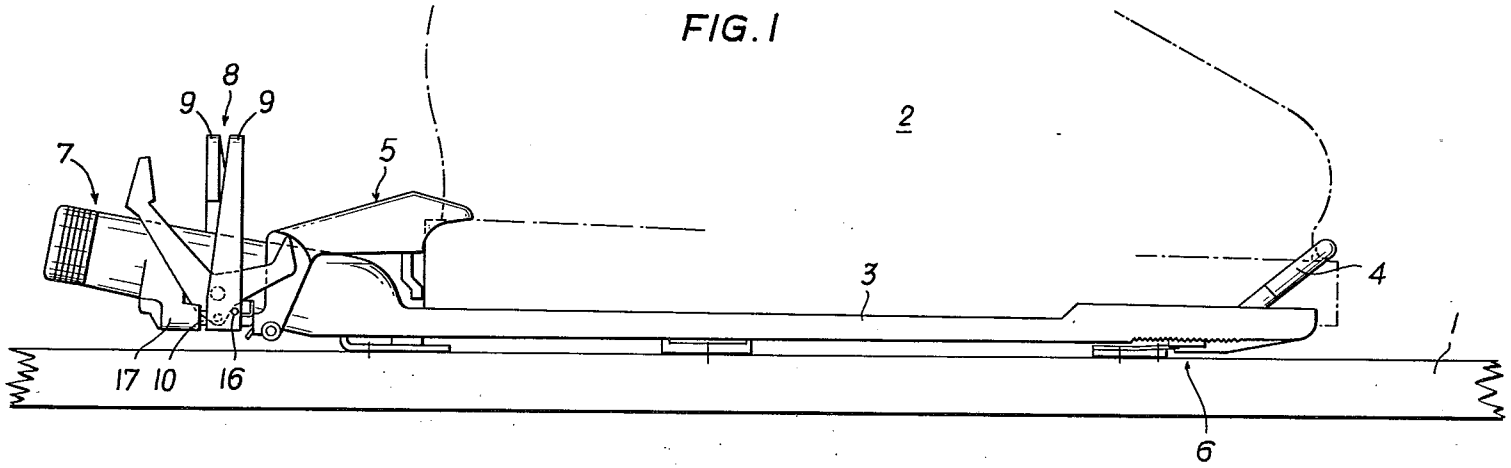
Figure 2:
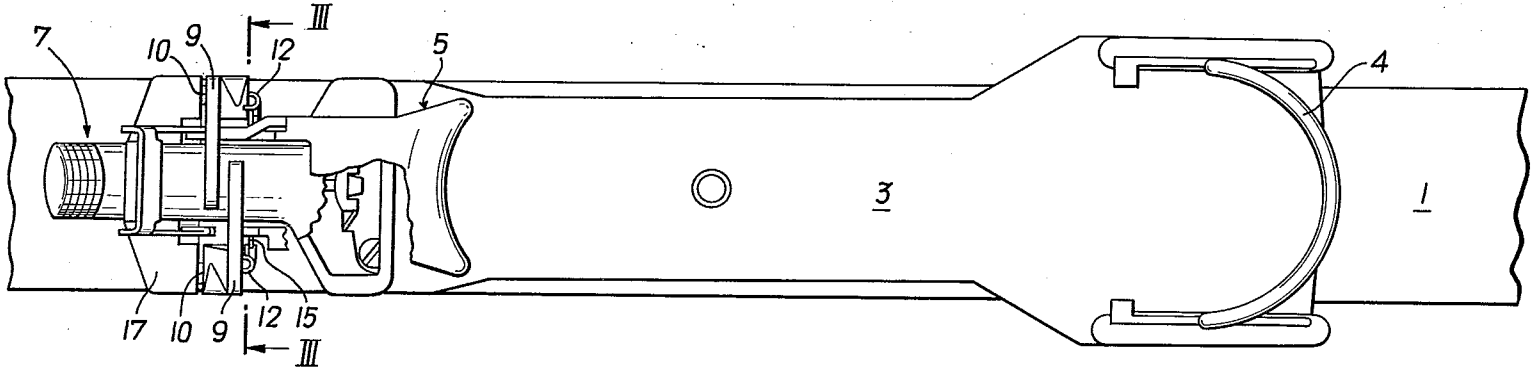
Figure 4:
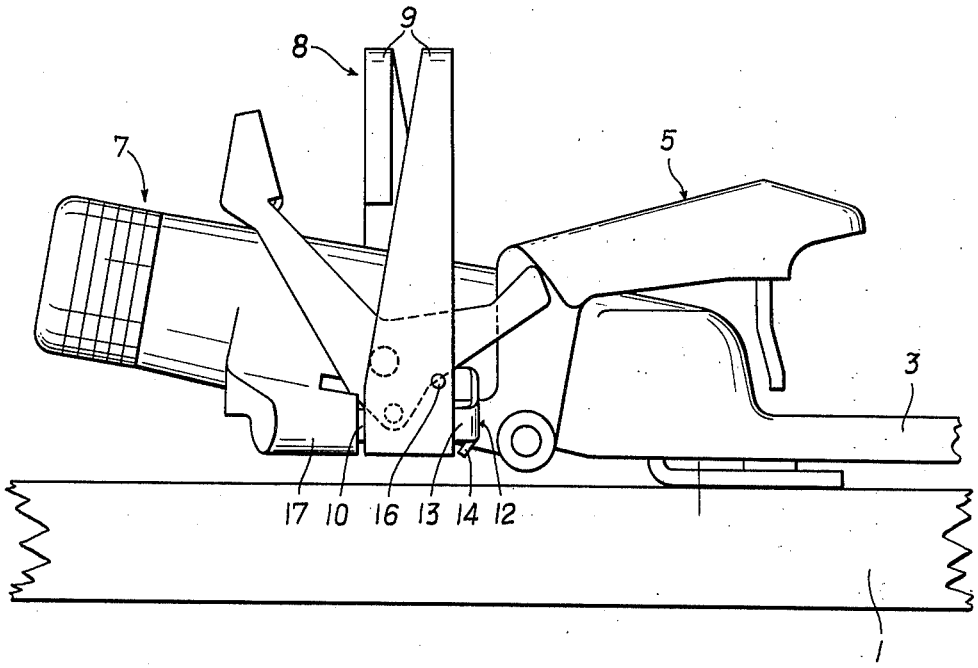
FIGS. 4 and 5 show enlarged details of FIGS. 1 and 2.
Figure 5:
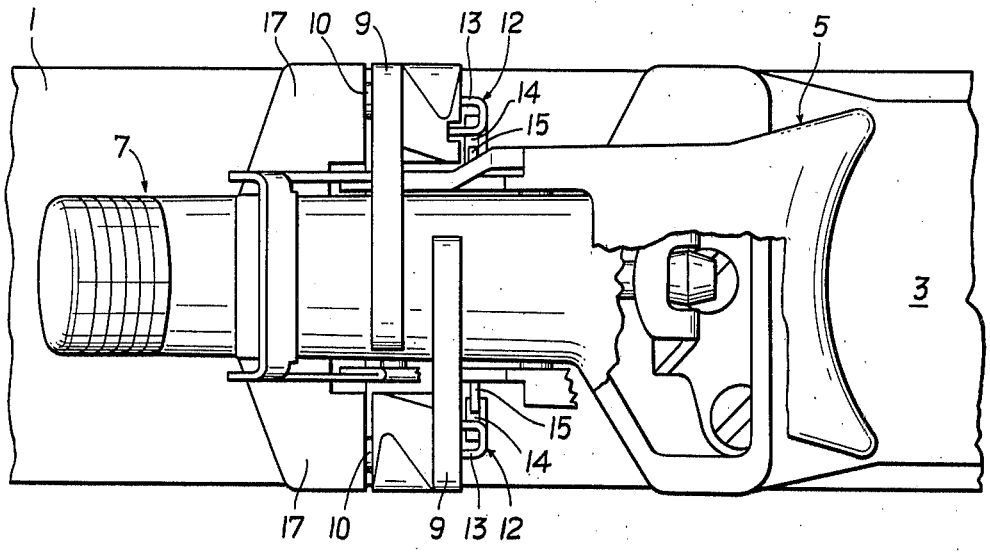

As can be recognized from FIGS. 1 and 2, the ski boot 2 which is only indicated in FIG. 1 is arranged on the ski 1 with the interpositioning of a sole plate 3 and is held on said sole plate 3 by means of a front holding mechanism 4 and by means of a heel holder 5. Front and rear locking mechanisms, which as a whole are identified by reference numerals 6 or 7, are used to hold the sole plate 3 on the ski 1. Since these may be of a conventional type, and since these do not form the subject matter of the present invention, they are not discussed further.

The inventive ski brake is related with the heel apparatus 5 in such a manner that the ski brake 8 is held in the running position by the heel apparatus 5 on the ski. The ski brake has brake parts 9 which are constructed as wings (compare in particular FIG. 3), which brake parts are moved into braking position during a release, namely freeing of the boot from the holding mechanism 4,5, about respective pivot shafts 10 which extend in longitudinal direction of the ski and each pivot shaft is provided with a slot 11. Such a ski brake can be designed as it is described, for example, in German Offenlegungsschrift No. 3,360,338. For this reason, no further description of the structure and operation of this known construction is given.

Since the invention relates only to the mounting and cooperation of the locking member and ski brake, it is also possible to use a ski brake of a different known type. It is only important that the ski brake is held in the running position by the heel holder through the locking member and is released by same during the release.

OPERATION

Figure 7:
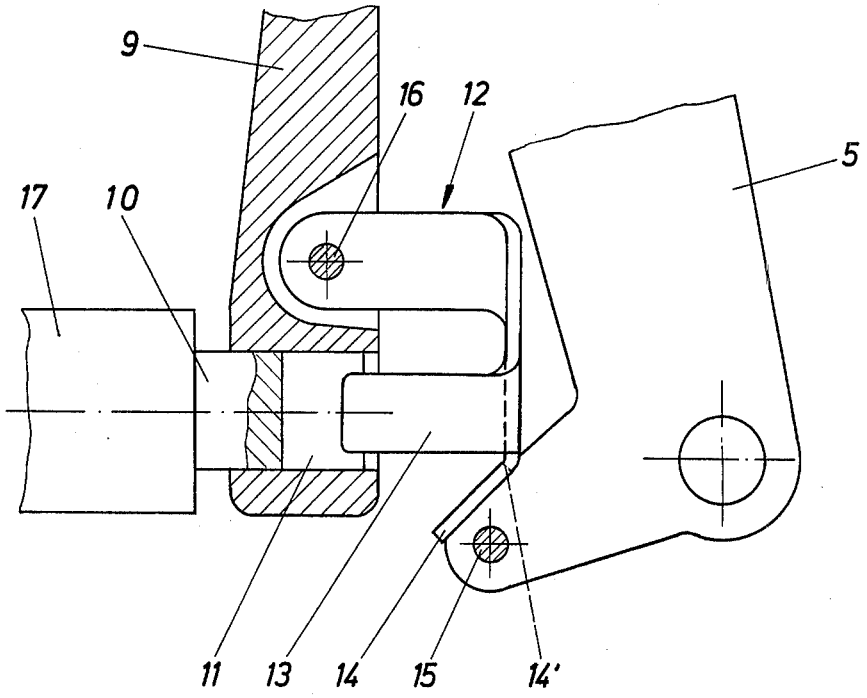
FIGS. 7 through 10 are various relative positions of the operating parts of the ski brake and one of the controlling heel holders.
Figure 8:
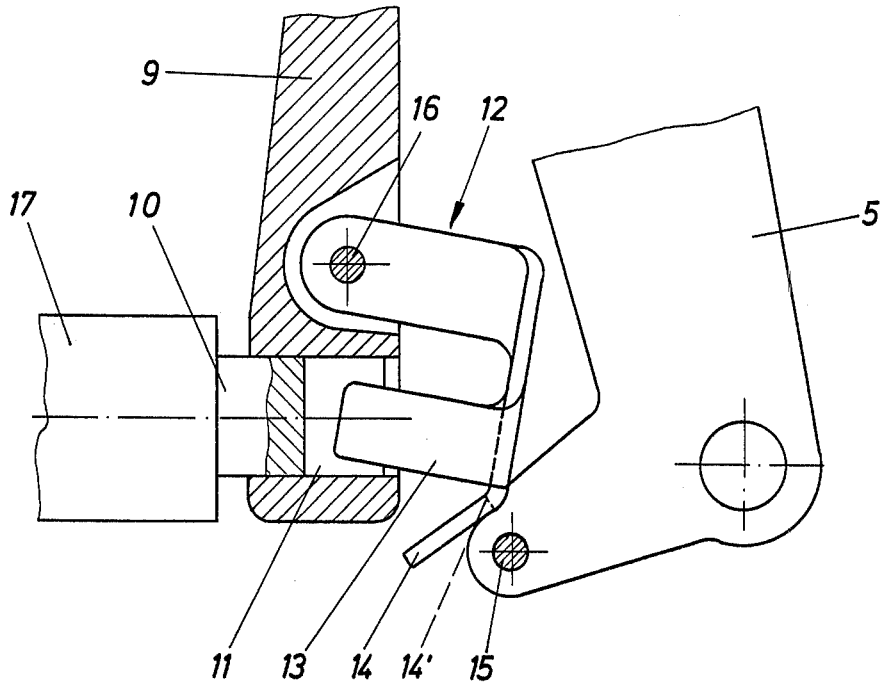

The inventive ski brake operates as follows (see particularly FIGS. 7–10):

Prior to the clamping of the heel holder 5, each brake wing 9 must be manually swung upwardly into its initial or raised non-braking position, as illustrated by solid lines in FIG. 3. Each brake wing 9 has a locking member 12 swingably mounted thereon by means of a torsion rod 16, the axis of which extends substantially perpendicular to the axis of the pivot shaft 10. When the brake wing 9 reaches its raised non-braking position, as shown in FIGS. 3 and 6, the torsion rod 16 resiliently urges the locking member 12 in a clockwise direction as viewed in FIG. 7 so that the locking plate 13 on member 12 enters into a slot 11 which is provided in the end of the fixed pivot shaft 10. Torsion rod 16 urges the locking plate 13 into the slot 11 so that same assumes the locking position shown in FIG. 7. The brake wing 9 is thus lockingly held in its raised non-braking position as shown in FIG. 3. When in this position as shown in FIG. 7, the torsion rod 16 is substantially in a neutral or relaxed condition, so that any swinging movement of the locking member 12 away from this position, in either direction, is in opposition to the urging of the torsion rod.

With the brake wings locked in their raised positions, as explained above, the heel holder 5 is now closed so as to lockingly engage the ski boot. This closing of the heel holder 5 causes it to move upwardly from the position shown in FIG. 7 into the position shown in FIG. 8, whereupon the cam pin 15 on the holder 5 engages the baffle or camming flange 14 on the locking member 12 and slides upwardly therealong, whereby locking member 12 is swung clockwise so that locking plate 13 penetrates still deeper into the slot 11. When the heel holder 5 reaches its fully closed position (due to continued upward movement from the position shown in FIG. 8), the cam pin 15 passes over the upper edge 14' of the camming flange 14, whereupon the torsion rod 16 causes the locking plate 12 to again swing counterclockwise from the position shown in FIG. 8 into its neutral or centered position shown in FIG. 10, in which position the locking plate is still engaged within the slot 11. When in this latter-mentioned position, substantially as illustrated in FIG. 6, the running position of the ski is achieved. Further, when in this running position, the cam pin 15 on the holder 5 is now positioned on the rearward side (leftward side in FIGS. 9 and 10) of the camming flange 14.

Figure 9:
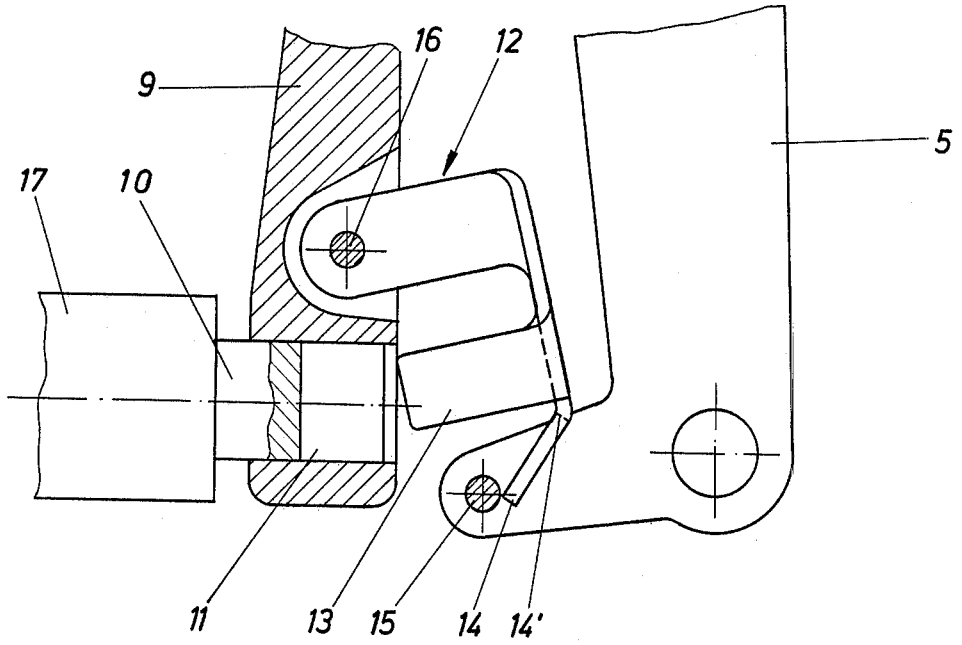
Figure 10:
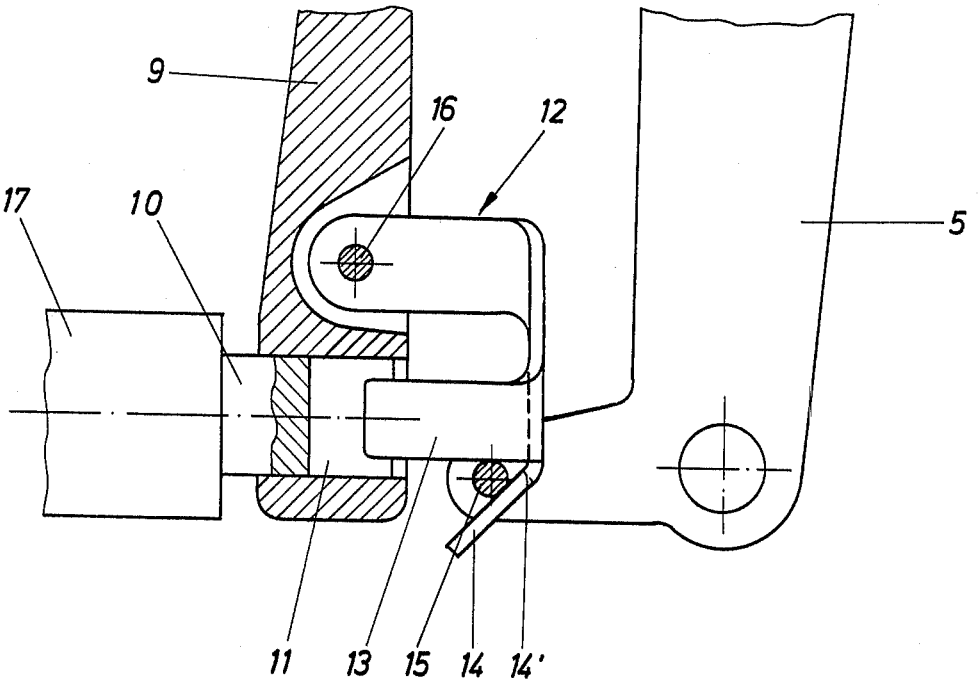

If the heel holder 5 is now opened either intentionally or accidentally, then the cam pin 15 slides downwardly along the inner surface of the camming flange 14 and accordingly rotates the locking member 12 in a counterclockwise direction in opposition to the torsion rod 16 so that the locking plate 13 is withdrawn from the slot 11 substantially as illustrated in FIG. 9. When locking plate 13 is withdrawn from slot 11, the brake wing 9 is released and, in a manner which is well known, is moved into its braking position, substantially as illustrated by dotted lines in FIG. 3. In the illustrated embodiment, a torsion-type coil spring 18 acts between the housing 17 and the brake wing 9 for moving the brake wing into the braking position shown by dotted lines in FIG. 3, in which position the brake wing projects below the ski 1. By manually swinging the brake wing 9 back into its upper position, the brake wings can again be locked in their raised positions to permit continued use of the ski.

The embodiments of the invention in which an exclusive property or privilege is claimed are defined as follows:

1. A ski brake for use on a ski, comprising:

a base;

a sole holder movably secured to said base and being movable between a ski boot holding position and a ski boot releasing position;

at least one ski brake arm pivotally secured to said base and being movable between a retracted position and a braking position;

first resilient means for biasing said ski brake arm toward said braking position;

releasable locking means for holding said ski brake arm in said retracted position when said sole holder is in said ski boot holding position and for releasing said ski brake arm to permit movement of said ski brake arm toward said braking position in response to a movement of said sole holder to said ski boot releasing position, said releasable locking means including a movable locking element on said ski brake arm and second resilient means therefor for biasing said locking element into locking relation with said base to effect said holding of said ski brake arm in said retracted position and a cam member operatively connected to said sole holder and engaging said locking element and being movable in response to a movement of said sole holder, said cam member effecting an unlocking of said locking element from said base in response to said movement of said sole holder so that said first resilient means will urge said ski brake arm to said braking position.

2. A ski brake according to claim 1, wherein said ski brake arm is pivotally secured to said base and movable about an axis of a pivot shaft extending generally parallel to the longitudinal axis of said ski.

3. A ski brake according to claim 1, wherein said ski brake arm is pivotally secured to said base and movable about an axis of a pivot shaft, said pivot shaft having a blocking slot therein, said locking element being movable into said blocking slot for holding said ski brake arm in said retracted position and out of said blocking slot for releasing said ski brake arm.

4. A ski brake according to claim 3, wherein said second resilient means resiliently holds said locking element in a position generally centered between its limits of movement, said centered position effecting said holding of said ski brake arm in said retracted position;

wherein said cam member with said ski brake arm in said retracted position engages one side of said locking element during a movement of said sole holder from said ski boot releasing position toward said ski boot holding position to urge said locking member in a first direction from said centered position into said blocking slot to maintain said ski brake arm in said retracted position and until said sole holder is in said ski boot holding position, at which time said cam member becomes disengaged from said locking element and said locking element returns to said centered position after which a movement of said sole holder toward said ski boot releasing position will effect engagement of said cam member with the other side of said locking element to effect a movement of said locking element in a second direction from said centered position out of said blocking slot to permit said movement of said ski brake arm to said braking position.

5. A ski brake according to claim 4, wherein said locking element includes a baffle member, the opposite sides of which are engaged by said cam member.

* * * * *